United States Patent [19]

Price

[11] 4,131,312

[45] Dec. 26, 1978

[54] OUTDOOR FURNITURE WITH REMOVABLE WEATHER COVER

[76] Inventor: Robert J. Price, 10 Steepletop Rd., Rowayton, Conn. 06853

[21] Appl. No.: 779,034

[22] Filed: Mar. 18, 1977

[51] Int. Cl.[2] ..... A47C 7/00

[52] U.S. Cl. ..... 297/184

[58] Field of Search ..... 297/184, 219; 135/5 R; 105/329 SC, 329 S

[56] References Cited

U.S. PATENT DOCUMENTS

| | | | |
|---|---|---|---|
| 327,105 | 9/1885 | Pierce | 297/184 X |
| 1,233,032 | 7/1917 | Cooley | 297/78 A |
| 3,321,240 | 5/1967 | Lilienstern et al. | 297/184 |
| 4,027,915 | 6/1977 | Anderson et al. | 297/184 |

FOREIGN PATENT DOCUMENTS

| | | | |
|---|---|---|---|
| 1914131 | 1/1970 | Fed. Rep. of Germany | 297/184 |
| 2250512 | 5/1974 | Fed. Rep. of Germany | 297/184 |
| 42159 | 2/1908 | Switzerland | 297/184 |
| 28327 | 11/1903 | United Kingdom | 297/184 |

*Primary Examiner*—James T. McCall

[57] ABSTRACT

The disclosure relates to outdoor furniture, particularly chairs and the like, provided with removable weather protection. A unitary chair body is provided, typically of molded plastic, to form integral seat, back, side and armrest portions. The chair body is of a generally weather-tight construction on the bottom, back and sides. Weather protection from the top and front is provided by means of a removable weather cover, which extends generally from the upper edge of the chair back to the front edge of the chair bottom and extends from one armrest to the other to completely cover the main recess of the chair. The weather cover is of a self-supporting construction, and both the chair and the cover are especially designed and especially adapted to accommodate the use of the cover in its closed position and also to provide for convenient storage of the cover when the chair is in use. The cover can take any of several forms, including a flat, rigid snap-on type, a tambour configuration, and a roll top configuration.

12 Claims, 12 Drawing Figures

OUTDOOR FURNITURE WITH REMOVABLE WEATHER COVER

BACKGROUND AND SUMMARY OF THE INVENTION

Outdoor furniture typically is designed and constructed to withstand reasonable exposure to the elements. Nevertheless, when such furniture is left exposed to the elements for even a few days, it may be covered with dirt, grime and debris. The problem is particularly acute where the furniture is out in the open, but can be quite annoying even where the furniture is partly protected, as under an open porch roof, for example. Where the furniture is thus exposed to the action of the elements, it frequently will be necessary to wipe off or even wash the furniture before use, greatly inhibiting its spontaneous utilization.

Pursuant to the present invention, an outdoor chair or the like is constructed in a unique and advantageous manner, so as to accommodate and provide for the use of an individual, self-storing weather cover, which may be quickly and easily put into place after use of the chair, and just as easily removed and self-stored when the furniture is to be used. Pursuant to the invention, a chair body is designed and constructed so as to be relatively weather-tight along the bottom, back and sides. To greatest advantage, this can be accomplished by forming the chair body of single-piece construction, such as a molding of plastic or fiberglass reinforced plastic, or a metal stamping, for example. The chair body is so designed and constructed as to receive over the top and front a self-storing cover which, when moved into covering position, serves to seal off in a substantially weather-tight manner the top and front of the chair body, so that the entire unit is substantially weather-tight.

In one of its more simplified and advantageous forms, the chair body is so constructed that its sides extend in a generally straight line from the upper edge of the chair back to the front edge of the chair bottom, so as to lie generally in a common plane with those two edges. A weather cover of generally flat form may then be placed over the top-front of the chair to completely enclose the seat and back rest area.

Pursuant to one of the more specific aspects of the invention, a generally flat weather cover may be provided, which is in the form of a rigid, molded or shaped, self-supporting panel, which can be snapped in place over the front of the chair during periods of nonuse. When the chair is to be used, the cover panel is simply snapped off and placed in a storage position extending downward along the back of the chair support.

In accordance with another specific aspect of the invention, the weather cover may take the form of a self-coiling plastic sheet mounted in a manner to form a tambour-type cover. In its self-storing position, the cover is contained in coiled form in a cylindrical housing extending along the top of the chair back. The cover is brought into operative position by being withdrawn downwardly, much in the manner of a window shade, and being guided and confined along the side edges of the chair. In its fully extended position, the tambour cover extends to the front lower edge of the chair and completely encloses the seat and back rest area.

Pursuant to another aspect of the invention, the self-storing cover is generally semi-cylindrical in form and has side walls which extend to and are pivoted by the sides of the chair body. The dimensions of the cover are such that, when it is pivoted into its operative position, it completely encloses the open side of the chair, and the side walls of the cover extend down at least to and preferably slightly below the upper edges of the chair sides. For utilization, the cover is merely pivoted upwardly and rearwardly, being stored in back of and underneath the chair body. In this last described embodiment of the invention, the chair body is supported from the front only, so that the back of the chair is open and clear to receive the pivoting cover.

For a more complete understanding of the above and other features and advantages of the invention, reference should be made to the following detailed description of preferred embodiments and to the accompanying drawing.

DESCRIPTION OF PREFERRED EMBODIMENTS OF THE INVENTION

Figure 1:
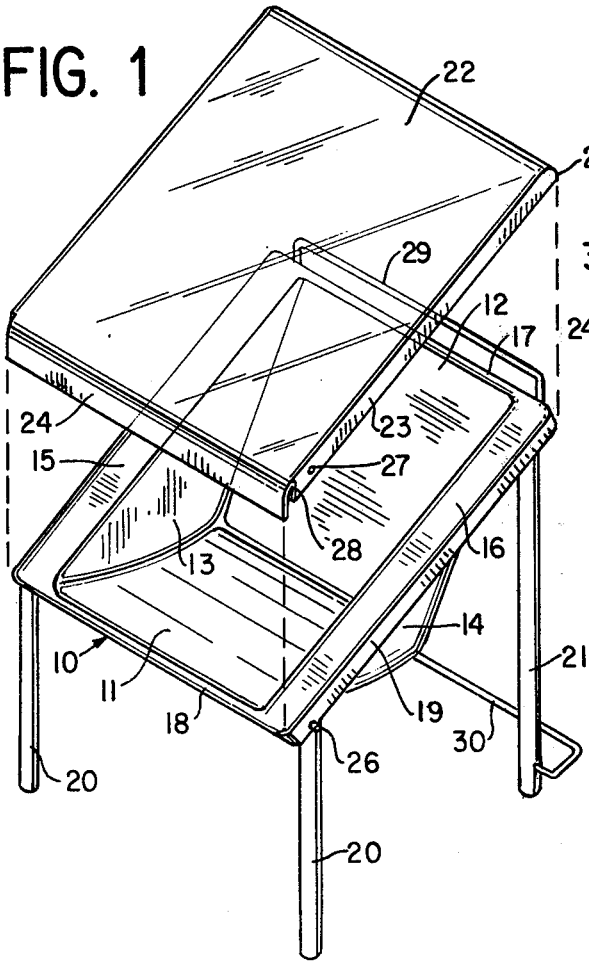
FIG. 1 is a perspective view of an outdoor chair and cover arrangement constructed in accordance with the principles of the invention.
Figure 2:
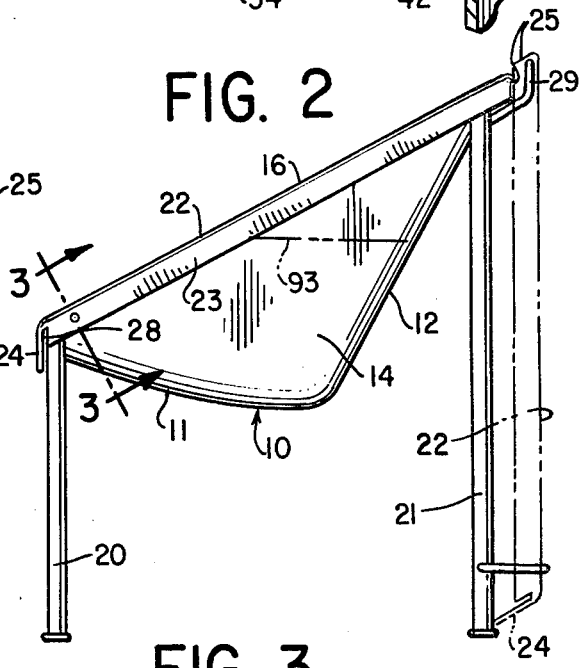
FIG. 2 is a side elevational view of the chair of FIG. 1, illustrating the cover in the closed position and additionally illustrating in phantom lines the cover in its open or removed position.
Figure 3:
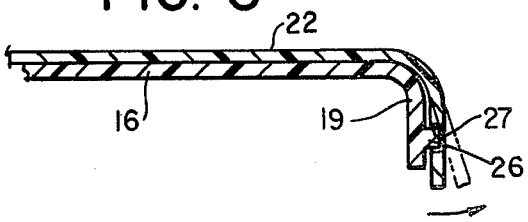
FIG. 3 is an enlarged, fragmentary cross sectional view taken generally on line 3—3 of FIG. 2.

Referring now to the drawing, an initially to FIGS. 1-3 thereof, the reference numeral 10 designates generally a chair body, which is advantageously of one piece construction, such as molded plastic or fiberglass reinforced plastic. The chair body 10 includes bottom and back panels 11 and 12 and side panels 13, 14. In the first illustrated form of the invention, flanges 15, 16 extend outward from the upper edges of the side panels 13, 14, forming armrests. These armrest flanges advantageously extend in a generally straight line from the upper edge 17 of the chair back 12 to the forward edge 18 of the chair bottom 11. The arrangement is such that armrest flanges 15, 16 and the edges 17, 18 are generally in a common plane. Desirably, the armrest flanges 15, 16 are provided with downwardly extending lip flanges 19 for appearance and additional strength.

In the form of the chair illustrated in FIGS. 1-3, the chair body 10 is suitably supported by front and back legs 20, 21, which may be of conventional construction and are secured in any suitable manner to the chair body.

One advantageous form of weather cover for the chair of FIG. 1 is in the form of a flat, relatively rigid plastic sheet 22 having depending side flanges 23 and front and rear depending flanges 24, 25. The dimensions of the flat panel 22 correspond substantially with the outside dimensions of the chair body recess, as defined by the armrest flanges 15, 16 and the upper and front edges 17, 18. The arrangement is such that the cover 22 may be placed over the top of the chair body, with the flanges 23–25 extending slightly downward below the surfaces on which the cover is supported, providing a substantially weatherproof enclosure.

For securely locking the cover 22 in place, short detent lugs 26 may be provided to extend outwardly from the lip flanges 19, near the front of the chair body. Cooperating openings 27 are provided in the depending side flanges 23 of the cover, as indicated particularly in FIG. 3. In placing the cover on the chair, the cover flanges 23 may be sprung outwardly in the regions of the apertures 27, as indicated in broken lines in FIG. 3, to enable the flanges to be received over the lugs 26. For this purpose, the lower edges of the cover flanges 23 may be cut away from the front flange 24, as indicated at 28.

When the cover 22 is properly assembled on the chair, the lower edge of the cover is locked in place by the lugs 26 while the upper edge of the cover is effectively locked by the rear cover flange 25, which extends generally vertically downward and forms an acute angle with the principal plane of the cover. When the cover 22 is removed from the chair, it is conveniently self-stored on the chair by means of a hanger bar 29, which extends across the back of the chair, advantageously being mounted at the upper ends of the back legs 21. In the illustrated arrangement, the hanger bar 29 extends rearward and upward from the chair legs 21 to provide adequate height above the floor level, for the cover to hang vertically without interference with the floor. Near the bottom of the chair legs 21, a retainer bar 30 extends across from one leg to the other and serves to confine the lower end of the cover in the self-stored position, as reflected in FIG. 2.

Alternatively, the cover 22 may be arranged for pivoting movement about an axis in the general area of the hanger bar 29. In such an alternative arrangement, the cover 22 would be simply lifted and pivoted upward and rearward to a self-storing position hanging downward along the back legs 21.

Figure 4:
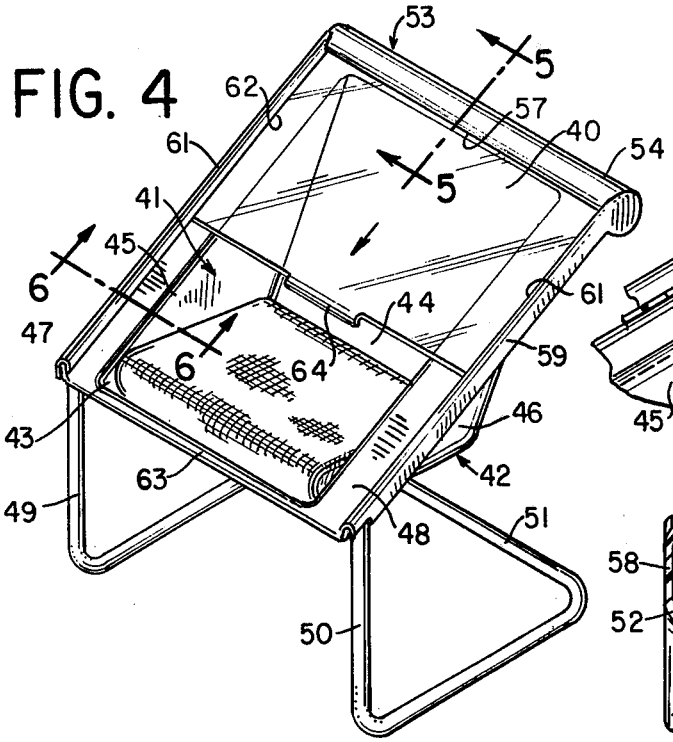
FIG. 4 is a perspective view of a second form of coverable outdoor chair according to the invention, utilizing a tambour style of self-storing cover.
Figure 5:
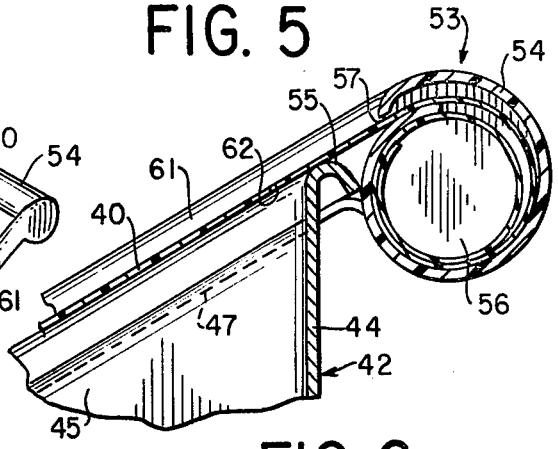
FIGS. 5 and 6 are enlarged, fragmentary cross sectional views as taken generally on lines 5—5, 6—6 respectively of FIG. 4.
Figure 6:
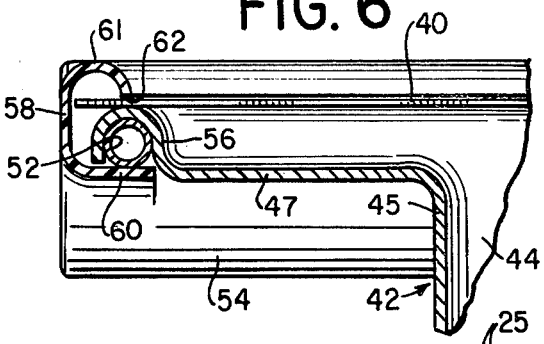

In the embodiment illustrated in FIGS. 4–6, a tambour style of weather cover is provided, in which a generally self-supporting, coilable plastic film or sheet 40 is arranged to be drawn over the front of the chair recess 41 to provide the desired weather protection. In the specific chair structure illustrated in FIG. 4, the chair body 42 may be constructed substantially along the lines of the chair body 10 of FIG. 1, including bottom and back panels 43, 44, opposed side panels 45, 46, and armrest flanges 47, 48. The chair body is of substantially weather-tight construction, ideally of a one piece molding or stamping. In the illustration of FIG. 4, the chair body 42 is provided with a front cantilever support, consisting of tubular front legs 49, 50 integrally connected with a U-shaped flat base 51. Tubular extensions 52 extend upwardly and rearwardly along the undersides of the armrest flanges 47, 48, advantageously being received in downwardly facing trough sections 53, as reflected in FIG. 6.

Secured to the chair body 42 is a housing and guide frame structure 53 for the cover sheet 40. The structure 53 includes a housing 54 of hollow, generally cylindrical form, which extends across the back of the chair, adjacent the upper edge 55 of the back panel 44. The housing 54 has a hollow, generally cylindrical interior 56 provided witha continuous, slot-like opening 57 extending across the full width of the housing and facing forwardly with respect to the chair body. At each end extremity of the housing 54 is a guide rail 58, 59, which may be integral with the housing and extends forwardly and downwardly along the outer edge of the respective armrest flanges 47, 48.

As reflected particularly in FIG. 6, the guide rail members 58, 59 are provided with lower, inwardly directed flanges 60, which extend under the armrest flanges 47, 48 and are suitably secured thereto by bolts or other fastening means (not shown). The guide rails additionally are provided with upper, inturned flanges 61, which extend a short distance over, and terminate a short distance above, the armrest flanges 47, 48, to form a narrow slot 62 extending the full length of the armrest. In the specific form of the invention illustrated in FIGS. 4–6, the upper guide flange 61 advantageously cooperates with the upper surface area of the arcuately sectioned tube receiving channel 56.

As reflected in FIGS. 5 and 6, the longitudinal slots 62 are aligned with the transverse slot 57 in the coil housing 54, defining a flat inclined plane extending over the upper surfaces of the chair body 42. In accordance with the invention, a self-supporting film or sheet 40 is provided, which is of sufficient width to extend across the full width of the chair and into the longitudinal guide slots 62, and is of sufficient length to extend from the front lip 63 of the chair body to the transverse housing slot 57. The sheet 40 may be formed of a clear Mylar film, for example, which has been heat set in coiled form, so as to readily self-coil within the housing 54, enabling the entire length of film to be stored in coiled form within the housing.

Along the lower or front edge of the sheet 40 a tongue or the like 64 may be provided to facilitate gripping the sheet for opening and closing movements. Likewise, if desired, the leading edge area of the sheet may be suitably reinforced or stiffened.

In order to bring the cover sheet 40 to closed position, the tongue 64 is manually gripped and drawn downwardly and forwardly. The sheet 40 is thereby uncoiled and drawn out of the housing much in the manner of a conventional window shade, except that the edge margins of the cover sheet are both guided and confined by the guide rails 58, 59 at each side of the chair body. Suitable stop means (not specifically shown) are provided to limit the maximum extension of the cover sheet, so that it is not entirely withdrawn from the housing 54. At full extension, the lower edge of the cover sheet 40 lies at least slightly below the level of the bottom panel of the chair body, so that precipitation is carried below the seat panel by the action of gravity. Where the full-extended position of the cover sheet 40 causes its leading edge to extend slightly beyond the lower ends of the guide rails 58, 59, the self-coiling characteristic of the film will cause it to curl downward and inward to form a highly effective closure, although typically that will not be necessary.

If the chair is utilized with a bulky cushion, portions of which may extend above the plane of the cover sheet in its closed position, as reflected in FIG. 4, the cushion may simply be tipped upward in the chair body recess and is thereby completely protected from the weather.

In the embodiment of the invention illustrated in FIGS. 7–12, the weather cover may be in the form of a generally semi-cylindrical housing 70, which is pivoted at the sides of the chair body 71 for limited rotational movement between covered and open positions of the chair. The chair body 71, as in the case of the previous embodiments, is of substantially weather-tight construction, comprising bottom and back panels 72, 73, side panels 74, 75 and armrest flanges 76, 77.

Whereas in the embodiments of FIGS. 1–6, it is convenient and advantageous for the armrest flanges to extend in a substantially straight line from the back to the front of the chair, the armrest flanges 76, 77 of the chair body 71 may more readily be of conventional configuration, projecting generally horizontally from the back panel 73. To advantage, however, the chair body 71 is of substantially uniform width, as are the chair bodies of FIGS. 1–6 in order to facilitate close fitting of a cover 70 of generally simplified contours. In this respect, while more complex contours might be imparted to the chair bodies within the purview of the present invention, such modifications may involve additional expense in tooling and manufacture and therefore desirably are to be avoided.

In the embodiment of FIGS. 7–12, the cover member 70 includes an outer panel 78, which is desirably of cylindrical contour and has integral side panels 79, 80 spaced apart a sufficient distance to be closely received over the side edge extremities of the chair body 71. Typically and advantageously, the cover 70 may be a unitary, thermo formed member of relatively rigid plastic material.

Figure 8:
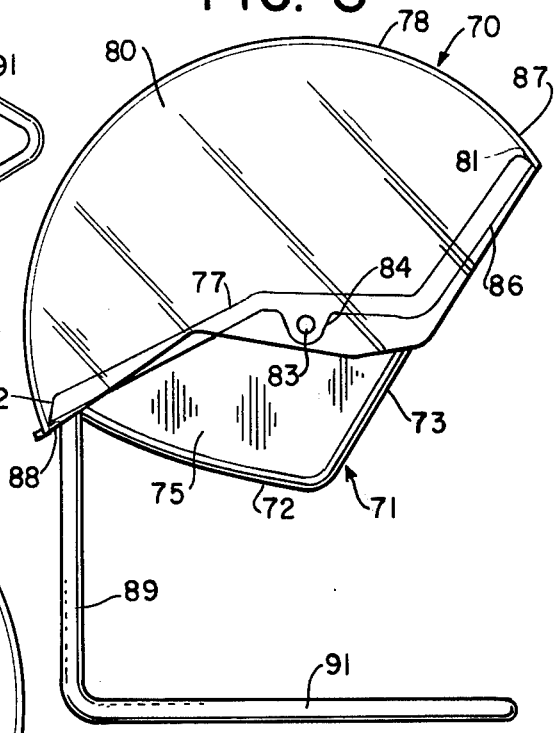
FIGS. 8 and 9 are side elevational views of the chair of FIG. 7, showing the cover in closed and open positions respectively.
Figure 12:
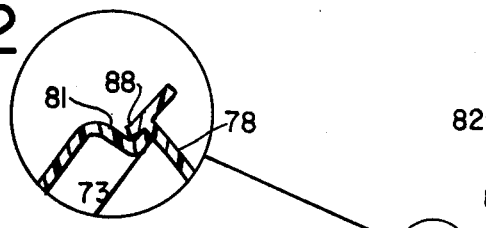
FIG. 12 is a cross sectional enlargement of a structural detail shown in the encircled portion of FIG. 9.

As reflected particularly in FIG. 8, the chordal dimension of the cover 70 is sufficient to enable it, when in the closed position, to extend from the upper edge extremity 81 of the chair back panel 73 to the front edge extremity 82 of the seat panel 72. The side panels 79, 80 of the cover are sufficiently deep as to include the center of curvature of the cylindrical outer panel 78, and the cover is pivoted to the chair body at such center of curvature. Conveniently, this may be accomplished by providing a pivot lug 83 extending outward from a depending lip flange 84 provided along the edges of outer edges of the armrest flanges 76, 77. The pivot lugs 83 are received in similar openings 85 provided in the cover side panels 79, 80, as reflected particularly in FIG. 11. Advantageously, the pivot lugs 83 are located in a plane perpendicular to and bisecting a plane which extends from the upper extremity 81 to the front extremity 82 of the chair body, and the radius of the cylindrical contoured cover panel 78 is such that the panel barely clears the chair body extremities 81, 82, extending slightly below both when the cover is in its closed position. As also reflected in FIG. 8, the dimensions of the side panels 79, 80 are such that, when the cover is in its closed position, the side panels extend alongside and slightly below the lip flanges 84 of the armrests, and also below similar lip flanges 86, which are provided along the upper portions of the back panel 73.

Figure 7:
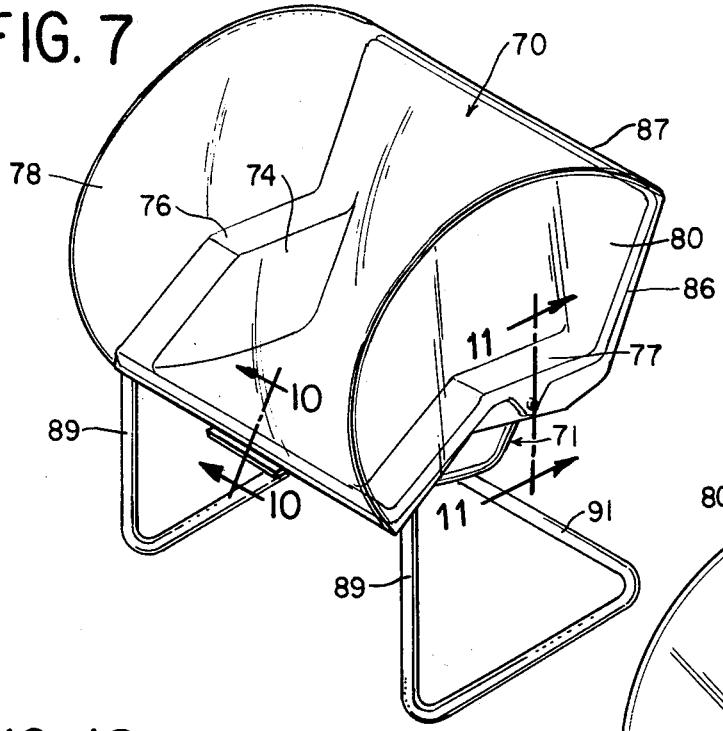
FIG. 7 is a perspective form of still another form of the invention, utilizing a roll top style of weather cover.
Figure 11:
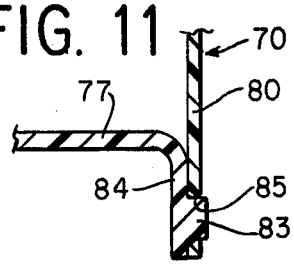
FIGS. 10 and 11 are enlarged, fragmentary cross sectional views as taken generally along lines 10—10, 11—11 respectively of FIG. 7.
Figure 9:
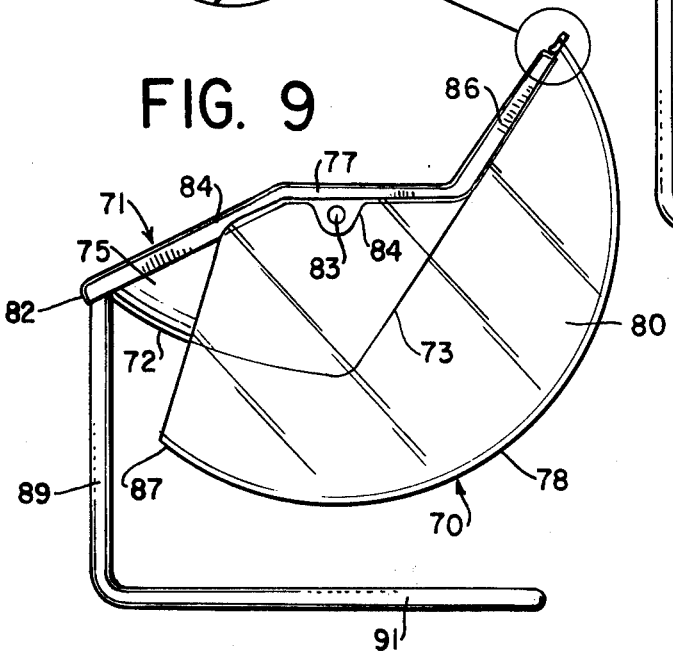
Figure 10:
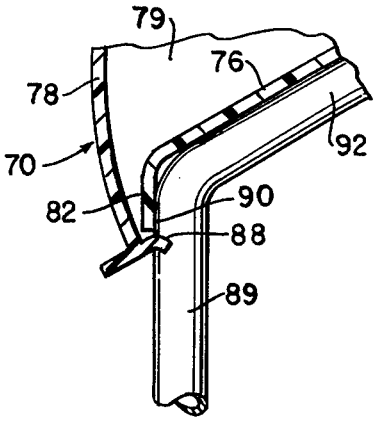

To open the cover 70, permitting utilization of the chair, the cover is pivoted in a clockwise direction, as viewed in FIGS. 7–9. The back portion 87 of the cover pivots downward and forward, underneath the chair body to its self-storing position as reflected in FIG. 9. Desirably, means are provided for determining limit positions of the cover 70, in both its closed and its open positions. This may be accomplished by providing small radial stop lugs 88 adjacent the front corners of the cover panel 78. In the closed position of the cover, the stop lugs 88 engage chair legs 89, to be further described, to provide a limit to the forward or counterclockwise pivoting movement of the cover. Additionally, the stop lugs 88 may be arranged to snap underneath a front lip flange 90 (see FIG. 10), serving as a spring detent to maintain the cover in a closed position. When the cover is raised, the stop lugs 88 engage the upper edge of the back panel 73, as refflected in FIG. 12.

As is evident in FIG. 9, in the open position of the cover 70, the cover self-stores underneath the chair body 70. To accommodate this self-storing action, the back area of the chair body must be open. Accordingly, in the modification of the invention illustrated in FIGS. 7–12, the chair body is provided with a front cantilever support, comprising front legs 89, connected to a flat U-shaped base 91 and having portions 92 extending upward and rearward underneath the armrest flanges 76, 77.

In any of the various forms of the invention, the chair body is specially constructed to accommodate a self-storing weather cover, which is not only convenient to utilize but may be provided with a minimum of additional manufacturing cost. The provision of such a cover enables an outdoor chair to be closed up after use and to remain substantially in pristine condition until subsequent use, notwithstanding continuous exposure to precipitation and windblown dust and debris.

To greatest advantage, a chair body adapted for the invention is of generally rectangular exterior outline, so that a cover of simplified configuration may be provided. In addition, in one of the more simplified forms of the invention, outwardly extending armrest flanges are provided, which extend more or less in a straight line from the upper back edge of the chair to its lower front edge. This greatly simplifies the design of both the chair and the cover and lowers the manufacturing cost of the unit.

While the form of the cover shown in FIGS. 9–12 easily accommodates a more conventionally contoured armrest flange, the embodiments of FIGS. 1–3 and 4–6 may also be designed to provide contours in the armrest flange area. This may be accomplished, in one alternative, by recessing inner portions of the armrest flanges, while the outermost edge extremities thereof extend in a generally straight line from the top to the front of the chair body. In another alternative, the entire armrest flange may be contoured, in the manner of the embodiment of FIGS. 7–12. In such cases, a cover of the type shown in FIG. 1 may be provided with wing-like extensions, as shown in broken lines at 93 in FIG. 2, to extend downward sufficiently to embrace the contoured armrest flanges. In the embodiment of FIG. 4, such contoured armrest flanges may be accommodated by similarly contouring the guide rails 58, 59 and causing the flexible cover sheet 40 to be guided along such contours.

As will be readily apparent, many additional modifications will suggest themselves to those skilled in the art and may be constructed without departing from the teachings of the disclosure. Accordingly, reference should be made to the following appended claims in determining the full scope of the invention.

I claim:

1. A weather protected outdoor chair or the like, which comprises
(a) a chair body having bottom, back and side wall panels,
(b) said panels forming an upwardly and forwardly facing body receiving recess,
(c) said panels and chair body being so constituted and assembled as to be relatively weatherproof to the wind-driven elements except as to the upwardly facing recess,
(d) a cover removably received on said chair body,
(e) said cover being structurally self-supporting and, when in covering position, serving to fully protect said recess from wind-driven elements,
(f) means for supporting the chair body,
(g) means on the chair body and/or supporting means for retaining said cover in an inactive position,
(h) said chair body having opposed, laterally outwardly extending substantially continuous flanges, extending substantially uninterruptedly from the upper edge of the back panel to the forward edge of the front panel,
(i) intermediate portions of said substantially continuous flanges forming armests,
(j) said cover having first portions extending laterally outward over the upwardly facing surfaces of said substantially continuous flanges and second portions extending downwardly in regions laterally outward of said flanges.

2. A weather protected outdoor chair or the like according to claim 1, further characterized by
(a) said cover comprising a substantially rigid, generally flat sheet-like cover panel, and
(b) said panel having downwardly extending flanges along its peripheral edges for engaging and enclosing said chair body.

3. A weather protected outdoor chair or the like according to claim 2, further characterized by
(a) said chair body and substantially continuous flanges being generally rectangular in outline,
(b) said cover panel being of similar rectangular outline and having downwardly extending flanges along its front and back edges and aling its side edges,
(c) said cover panel being downwardly and forwardly inclined when in covering position, and being supported in part in such position by engagement of its back edge flange with the upper edge of the back panel of said chair body.

4. A weather protected outdoor chair or the like according to claim 2, further characterized by
(a) said chair body and substantially continuous flanges being generally rectangular in outline,
(b) said cover panel being of similar rectangular outline and having downwardly extending flanges along its front and back edges and along its side edges,
(c) said cover panel being supported in part in covering position by engagement of its side edge flanges with the substantially continuous flanges of the chair body.

5. A weather protected outdoor chair or the like according to claim 4, further characterized by
(a) cooperating detent retainer means on the cover side edge flanges and the armrest flanges for securing the cover panel in covering position.

6. A weather protected outdoor chair or the like according to claim 2, further characterized by
(a) said retaining means comprising means for suspending the cover panel in a generally vertical position, extending downward from a level adjacent the upper edge of the back panel.

7. A weather protected outdoor chair or the like according to claim 1, further characterized by
(a) said cover comprising a coilable sheet of sufficient length and width to cover said recess,
(b) storage means at one of the front or back edges of the recess for receiving the sheet in coiled form,
(c) said cover including guide means extending along said armrest flanges generally between the front and back edges of said recess for guiding and confining said sheet as it is progressively uncoiled.

8. A weather protected outdoor chair or the like according to claim 7, further characterized by
(a) said storage means comprising a generally cylindrical housing mounted adjacent the upper edge of the back panel, and
(b) said guide means comprising guide rail members secured to said substantially continuous flanges, along the outer edge margins thereof, and forming opposed guide tracks for the side edges of said sheet.

9. A weather protected outdoor chair or the like according to claim 8, further characterized by
(a) said housing and said guide rail members comprising a unitary, U-shaped member secured to said chair body.

10. A weather protected outdoor chair or the like according to claim 1, further characterized by
(a) said cover being of generally rigid construction and of top and side panels,
(b) said cover side panels being mounted for pivoting movement to accommodate movement of said cover between closed and open positions.

11. A weather protected outdoor chair or the like according to claim 10, further characterized by
(a) said cover being of generally semicylindrical configuration and of sufficient chordal length to cover the entire chair body recess, and
(b) said cover side panels extending to and being pivotally engaged by the sides of said chair body for pivotal movement of the cover about a generally horizontal, transverse axis.

12. A weather protected outdoor chair or the like according to claim 11, further characterized by
(a) the means for supporting said chair body comprising a front cantilever support,
(b) said chair body and said front cantilever support forming an open area below and behind said chair body for the reception of said cover below said chair body.

* * * * *